US010094644B2

(12) United States Patent
Ziegler

(10) Patent No.: US 10,094,644 B2
(45) Date of Patent: Oct. 9, 2018

(54) METHOD FOR INCREASING THE RANGE OF SPIN-STABILIZED PROJECTILES, AND PROJECTILE OF SAID TYPE

(71) Applicant: ALPHA VELORUM AG, Triesen (LI)

(72) Inventor: Martin Ziegler, Steinen (CH)

(73) Assignee: Alpha Velorum AG, Triesen (LI)

( * ) Notice: Subject to any disclaimer, the term of this patent is extended or adjusted under 35 U.S.C. 154(b) by 95 days.

(21) Appl. No.: 14/908,488

(22) PCT Filed: Jul. 30, 2014

(86) PCT No.: PCT/EP2014/066341
§ 371 (c)(1),
(2) Date: Jan. 28, 2016

(87) PCT Pub. No.: WO2015/014877
PCT Pub. Date: Feb. 5, 2015

(65) Prior Publication Data

US 2016/0169644 A1 Jun. 16, 2016

(30) Foreign Application Priority Data

Jul. 31, 2013 (CH) ..... 1342/13

(51) Int. Cl.
*F42B 10/38* (2006.01)

(52) U.S. Cl.
CPC ..... *F42B 10/38* (2013.01)

(58) Field of Classification Search
CPC ..... B64C 21/00; B64C 21/02; F42B 10/22; F42B 10/24; F42B 10/38
See application file for complete search history.

(56) References Cited

U.S. PATENT DOCUMENTS 2,110,264 A * 3/1938 Gerlich ..... F42B 14/02 102/501
2,507,878 A * 5/1950 Banning, Jr. ..... F41A 1/00 102/517

(Continued)

FOREIGN PATENT DOCUMENTS

FR 1 246 710 A 11/1960
GB 1 019 061 A 2/1966

OTHER PUBLICATIONS

Viswanath P R et al "Effectiveness of passive devices for axisymmetric base drag reduction at mach 2"; Journal of Spacecraft and Rockets, American Institute of Aeronautics and Astronautics, (1990).

(Continued)

*Primary Examiner* — Tien Q Dinh
*Assistant Examiner* — Michael A. Fabula
(74) *Attorney, Agent, or Firm* — Muncy, Geissler, Olds & Lowe, P.C.

(57) ABSTRACT

To increase the range of a spin-stabilized projectile which moves in a surrounding medium, the surrounding medium from a stagnant-water region of the projectile is, by means of a part of the rotational energy of the projectile, conveyed under the inflowing boundary layer at the outer surface of the projectile, and thus the speed gradient of the boundary layer in the vicinity of the wall is reduced. For this purpose, the outer surface has at least one encircling groove (9) which is connected by radial transverse ducts (10) to at least one longitudinal duct (11) in the interior of the projectile, which in turn is connected to an opening in the rear of the projectile.

15 Claims, 8 Drawing Sheets

(56) References Cited

U.S. PATENT DOCUMENTS

| | | | | | |
|---|---|---|---|---|---|
| 2,624,281 | A * | 1/1953 | McNally | F02K 7/08 | 102/511 |
| 2,793,592 | A * | 5/1957 | Kroeger | F42B 14/02 | 244/3.23 |
| 3,890,902 | A * | 6/1975 | Travor | F42B 12/06 | 102/518 |
| 3,913,489 | A * | 10/1975 | Travor | F42B 14/064 | 102/526 |
| 4,176,487 | A * | 12/1979 | Manis | F41A 21/00 | 102/470 |
| 4,379,531 | A * | 4/1983 | Manis | F41A 21/00 | 244/3.23 |
| 4,708,063 | A * | 11/1987 | Ladriere | F42B 30/02 | 102/516 |
| 5,381,736 | A * | 1/1995 | Kalcic | F42B 10/48 | 102/437 |
| 2011/0155014 | A1* | 6/2011 | Marx | F42B 10/26 | 102/517 |
| 2011/0155016 | A1* | 6/2011 | Marx | F42B 10/26 | 102/524 |
| 2016/0131465 | A1* | 5/2016 | Harrison | F42B 14/02 | 102/439 |

OTHER PUBLICATIONS

International Search Report and Written Opinion issued in PCT/EP2014/066341.

* cited by examiner

METHOD FOR INCREASING THE RANGE OF SPIN-STABILIZED PROJECTILES, AND PROJECTILE OF SAID TYPE

CROSS-REFERENCE TO RELATED APPLICATIONS

This application is the U.S. National Stage Entry under 35 U.S.C. § 371 of International Application No. PCT/EP2014/066341, filed on Jul. 30, 2014, which claims priority to CH Patent Application No. 01342/13, filed on Jul. 31, 2013, each of which is incorporated herein in its entirety.

FIELD OF DISCLOSURE

The invention relates to a method for increasing the range of spin-stabilized projectiles and a projectile of said type, where the boundary layer of a projectile is influenced by pumping some fluid from the stagnation area behind the base of a projectile into the boundary layer from underneath.

BACKGROUND

Spin-stabilized projectiles are fired from rifled or smoothbore barrels which make the bullet rotate quickly, either via spiral-shaped rifling or else a corresponding design of aerodynamically effective surfaces, which stabilizes the flight path by spinning forces. When fired from rifled barrels, depending on the spiral angle of the rifling, a few thousand rotations per second are achieved. After leaving the muzzle, the projectile is slowed down along its path by drag forces which depend on the shape of said projectile and on its speed.

- In the front nose portion of the projectile, it is mainly form drag forces comprising dynamic pressure and wave impedance that are active.
- In the central, usually cylindrically shaped, portion of the projectile, it is mainly frictional forces from the turbulent boundary layer that are active.
- In the rear tail portion, it is mainly forces from the pressure drop in the so-called stagnation area of the blunt base of the projectile that are active.

In order to achieve a high range, the bullet must have a high initial speed, preferably a supersonic speed, and the drag forces must be kept as low as possible, so that the energy loss of the projectile along the trajectory is minimized. For this purpose, the nose of the projectile has a drag-optimized shape, preferably that of an ogive, and the tail is slightly tapered, this being known as the boat tail, so that the effective cross section of the pressure drop at the base of the projectile is reduced. A further increase in the base pressure can be achieved by an additional outflow of gas at the projectile base, known as base bleed, as a result of which the range can be increased significantly.

The disadvantage with all projectiles is the loss of kinetic energy due to drag forces, which reduces the range and target impact of the bullet. In the case of base bleed bullets, the additional expenditure on propellant gas which has to be carried by the projectile and ejected along the trajectory is just as much a problem as the possibly irregular burn-off of corresponding gas-generating burn-off sets.

SUMMARY

The problem addressed by the invention is that of finding a method and a projectile which reduces the energy loss of the projectile along the trajectory without reducing the additional propellant gas charge and can therefore increase the range and target impact of said projectile.

These problems are solved by the present invention as further described and explained.

The method according to the invention and the projectile according to the invention are described or explained in greater detail below with the help of exemplary embodiments schematically represented in the drawing. Specifically,

BRIEF DESCRIPTION OF THE DRAWINGS

A more complete appreciation of aspects of the disclosure and many of the attendant advantages thereof will be readily obtained as the same becomes better understood by reference to the following detailed description when considered in connection with the accompanying drawings which are presented solely for illustration and not limitation of the disclosure, and in which.

DETAILED DESCRIPTION

The exemplary methods, apparatus, and systems disclosed herein advantageously address the industry needs, as well as other previously unidentified needs, and mitigate shortcomings of the conventional methods, apparatus, and systems.

Figure 1:
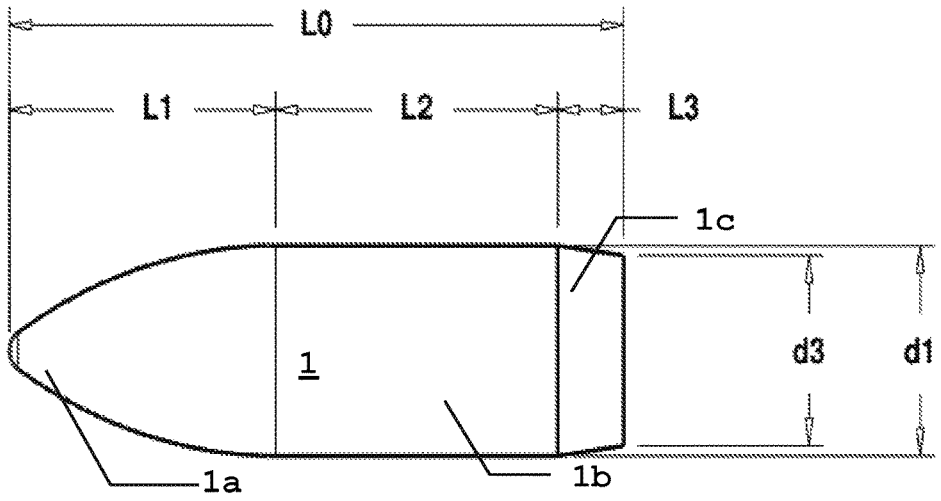
Fig. 1 Prior Art
FIG. 1 shows the representation of a spin-stabilized projectile according to the state of the art with an ogival nose, cylindrical center and tapered tail.

FIG. 1 shows a spin-stabilized projectile 1 according to the state of the art with an ogival nose and a projectile tip 1*a*, cylindrical center part 1*b* and tapered projectile tail 1*c*, as is also typical of small-caliber munitions up to and including .50 caliber BMG, i.e. 12.7×99 mm. Spin stabilization is usually achieved by firing from rifled barrels, but it can also be achieved by other means, such as oblique aerodynamically effective surfaces, for example. With regard to the action according to the invention, the occurrence of a rotation with a sufficiently high angular frequency is necessary, depending on the specific projectile design.

State-of-the-art projectiles or bullets often exhibit a shape, the associated total length L0 whereof can be divided into the three regions depicted in FIG. 1—the front part of length L1 with the nose and projectile tip 1*a*, the center part 1*b* of length L2, and the projectile tail 1*c* or projectile base of length L3. In the form shown with the boat tail, the tail diameter d3 is smaller compared with the caliber or center part diameter d1, so that an aerodynamic form is produced. The drag forces exerted in the space filled with air as the medium to be penetrated lead to a loss of kinetic energy. In this case, each part of the projectile 1 with a nose, center and tail contributes a specific share, wherein the energy loss thereof must correspond to an energy gain of its surrounding flow on account of energy conservation.

Figure 2:
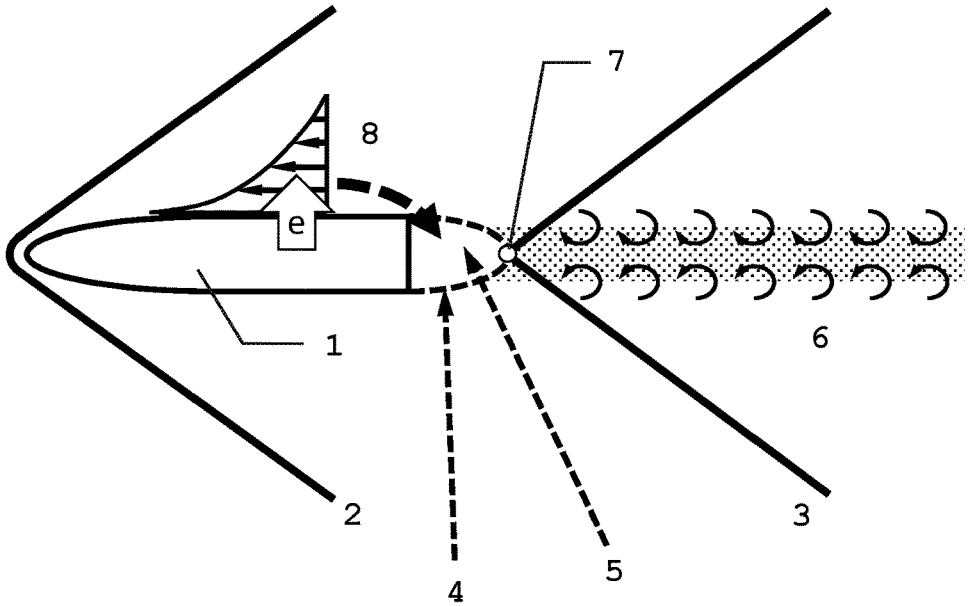
Fig. 2 Prior Art
FIG. 2 shows the schematic representation of the flow field around a supersonic projectile according to the state of the art with a Mach cone at the front and at the rear of the projectile, energy transfer to the boundary layer, slipstream body with stagnation area and turbulent wake.

The influences resulting during flight through the medium are depicted in FIG. 2 with the help of the flow field around a projectile 1 with a nose Mach cone 2 and a tail Mach cone 3 flying in the supersonic range at approx. 1.8 Mach, energy transfer e to the boundary layer 8, slipstream body contour 4 with so-called stagnation area 5 as the aerodynamic shadow occurring directly behind the projectile and turbulent wake 6 directly behind the projectile are depicted schematically in FIG. 2. The energy flow e into the boundary layer 8 of the projectile 1, which boundary layer forms a non-linear speed profile proximate to the wall and grows turbulently following a laminar starting phase until it separates at the blunt projectile tail, is explained. The boundary layer 8 is represented in fixed-base coordinates, wherein air or fluid particles are entrained in the flying direction proximate to the wall. Particles of this kind accumulate in the stagnation area 5 of the slipstream body which forms a free stagnation point 7. In the case of supersonic bullets, the tail Mach cone 3 of the tail shock wave begins there. In the wake 6 which then follows, the energy transmitted to the boundary layer 8 is turbulently dissipated.

These observations can be validated with the help of high-speed imaging. The following mechanisms are important during modelling:

- The energy loss e of the projectile 1 is the energy gain of the boundary layer 8.
- The speed gradient in the boundary layer 8 causes shear stress, giving rise to frictional forces and drag.
- In the stagnation area 5, the fluid following behind the projectile base is as fast as the projectile 1. The kinetic energy of the stagnation area 5 originates from the energy transfer e of the projectile 1 into the boundary layer 8.
- Energy from the stagnation area 5 passes into the turbulent wake 6 as the slipstream field.

Following to the teaching according to the invention, the energy loss of the projectile 1 can be reduced along its path, in that the speed profile of the boundary layer 8 is filled by supplying medium already moving at the projectile speed, which reduces the wall frictional forces. For this purpose, the rotation of the projectile 1 and the radial or centrifugal acceleration produced by this is used to convey fluid particles or particles of the medium from the stagnation area 5 of the projectile 1 into the boundary layer 8. Through this formulation, portions of the medium accumulated in the stagnation area 5 of the projectile 1 and moving at the projectile speed are conveyed at the outer surface of the projectile 1 underneath the inflowing boundary layer 8 by means of part of the rotational energy of the projectile 1 and the speed gradient of the boundary layer 8 therefore falls proximate to the wall. Viewed overall, the surrounding medium is therefore initially conveyed axially in the movement direction of the projectile 1 and then radially in a centrifugally accelerated manner to the outer surface thereof.

This method enables the range of a spin-stabilized projectile to be increased or the bullet drop per distance interval reduced, so that a flatter trajectory with a greater hit probability and higher energy in the target result.

Figure 3A:
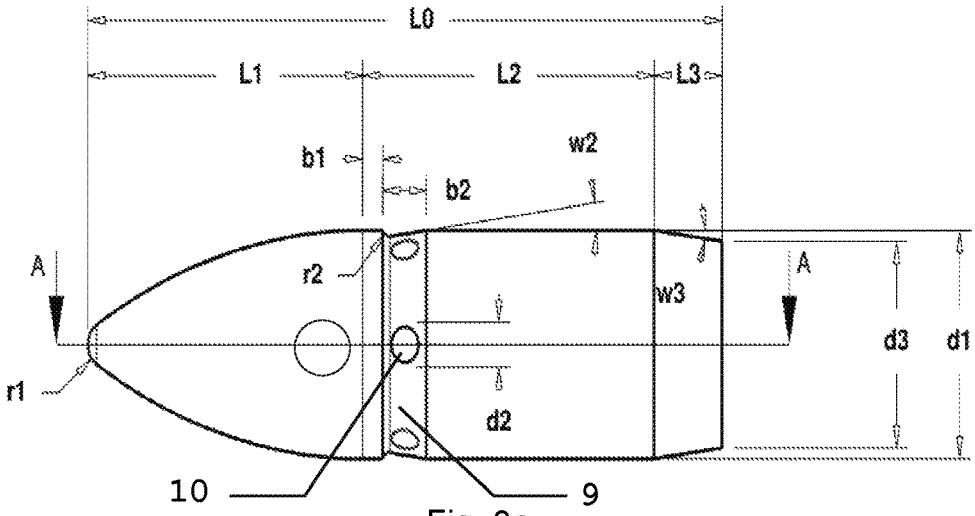
FIGS. 3*a-c* show the representation of a first exemplary embodiment of the projectile according to the invention as a side, a sectional, and a detailed view.
Figure 3B:
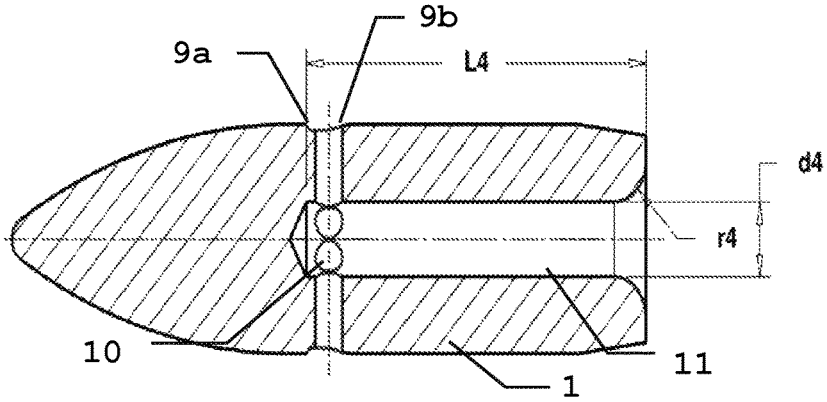
Figure 3C:
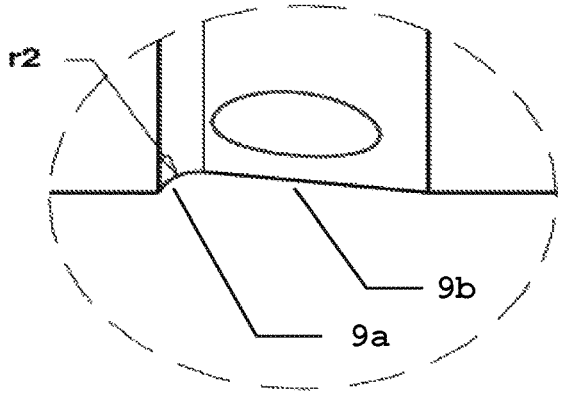

A first exemplary embodiment of the projectile according to the invention is represented in side, sectional and detailed views in FIGS. 3*a-c*.

FIG. 3*a-c* shows a first embodiment of the invention. The projectile 1 has a nose 1*a* with length L1 and tip radius r1, a center part 1*b* with length L2 and a boat tail 1*c* with length L3, totalling an overall length of L0. It has a circular groove 9 located at distance L4 from the base of the projectile 1. The boat tail is tapered by angle w3, reducing the diameter from d1 at the central part down to d3 at the base. The groove 9 has a steep upstream face 9*a* with edge radius r2 and a downstream face 9*b* with a small slope angle w2. The location of the groove 9 corresponds with the length L4 of the longitudinal channel 11 having a diameter d4 of one third of the central diameter d1. The channel 11 is connected to the groove 9 by radial channels with a bore diameter d2. FIG. 3*c* shows the groove geometry in detail with the steep upstream face 9*a* and the downstream face 9*b* with a small slope. The rear entry of the channel 11 is rounded by r4.

To implement the approach according to the invention, a state-of-the-art projectile may be changed as follows in purely exemplary fashion.

The spin-stabilized projectile 1 having an outer surface, a projectile tip and a projectile tail is configured in such a manner that the outer surface exhibits at least one encircling groove 9 which is connected by radial transverse channels 10 to at least one longitudinal channel 11 inside the projectile 1, which projectile is for its part connected to an opening in the projectile tail. In the projectile, this longitudinal channel 11 is for example configured as an axial or longitudinal bore from the base or the tail of the projectile to the height of the groove 9 encircling in its outer wall, from which groove the transverse channels 10 branch off substantially at right angles, i.e. in a radial direction, which can likewise be realized by corresponding bores. Alternatively, however, other kinds of production process can also be used according to the invention. The groove in this case is located as close as possible to the nose area, so that a large part of the outer surface can be influenced by the flow produced in relation to the flow field. In particular, the groove 9 can be arranged right at the front part of the substantially cylindrical center part of the projectile. Depending on the type of projectile and its length, however, a plurality of grooves can also be introduced into the outer wall or the outer surface of the projectile.

The transition between the longitudinal channel 11 and the base of the bullet or else the tail of the projectile is advantageously formed in a streamlined manner, for example by a rounding r4 of the transitional edge. The flow created there increases the base pressure at the tail of the projectile, which reduces the drag thereof. The diameter d4 of the longitudinal channel depends on various factors, such as, for example, the dimensions of the projectile, the inner design thereof and also the Mach number or flight or nozzle speed to be expected. The cross section of the longitudinal channel 11 may, in the simplest case, be of round and constant configuration, however other geometries can also be used according to the invention. Hence, the channel may also be polygonal or star-shaped in design and also configured with a length-dependently variable cross section. Due to the spin stabilization, however, a symmetrical weight distribution in relation to the axis of spin must be guaranteed. Likewise, according to the invention, rather than a single longitudinal channel 11, a multiplicity or plurality of channels of this kind may also be configured.

The longitudinal channel 11 is in contact with a plurality of uniformly radially distributed transverse channels 10 which connect the longitudinal channel 11, as the inner conveying channel, to the outer wall of the projectile 1 and terminate in the encircling groove 9. The rotation of the projectile 1 gives rise to a centrifugal force in these transverse channels 10 formed as bores, for example, and from this the desired conveying effect which conveys the fluid or surrounding medium from the stagnation area into the longitudinal channel 11 and finally into the boundary layer. The number of transverse channels 10 may be adapted to the corresponding projectile geometries and flow conditions and may be both an even and also an odd number, e.g. 2, 3, 4, 5, 6 or 8. Due to the avoidance of imbalance for the spin stabilization and a uniform lining action for the boundary layer, the transverse channels 10 are uniform, i.e. distributed equidistantly over periphery or, however, with the same angle division. As with the longitudinal channel 11, the transverse channels 10 may also comprise the different geometries mentioned in that context, in order to take account of the production and flow conditions. In particular, the radial transverse channels 10 may exhibit a sickle-shaped or curved profile running in or against the spinning direction, so that the flow behavior of the conveyed medium can be influenced by a component acting in or against the direction of rotation. Moreover, it is possible for the radial transverse channels 10 to be configured with a tapering path in or against the radial direction; in particular, the cross section d2 in the outlet region of the groove 9 can be expanded.

The length of the radial transverse channels 10 and therefore the fraction of the projectile diameter available for the centrifugal acceleration of the medium depends on the specific embodiment of the projectile 1 and the flight or rotational speed thereof. In particular, however, this may amount to at least a third of the diameter of the projectile 1 in each case.

The transverse channels 10 end in an encircling groove 9 as the collecting channel for the fluid flowing out of the transverse channels 10, wherein from the groove 9 the flowing surrounding medium or the boundary layer thereof is filled from underneath. It is advantageous for the groove 9 to be configured with a comparatively sharp edge towards the front, in order to enforce a flow detachment of the inflowing boundary layer, and to be provided with a flat transition towards the back, so that the conveyed fluid can be conveyed uniformly under the boundary layer flow flowing from the front and the speed profile thereof can be filled on the wall side. This means that the encircling groove 9 exhibits a profile, whereof the upstream side 9*a* is steeper than the downstream side 9*b*. For large caliber or long bullets, it may be advantageous for more than one groove to be provided with the associated transverse channels which follow one another axially and are connected via their respective transverse channels to the longitudinal channel to the projectile tail.

Both sides 9*a* and 9*b* of the encircling groove 9 must have the same outer diameter. The groove 9 acts as reservoir and spreads fluid evenly around the circumference of the projectile 1, after being pumped from inside the channel 11 through the radial channels 10 into the groove 9 by centrifugal forces. Due to the steep upstream side 9*a*, the boundary layer flowing in from the nose part 1*a* detaches from the wall. Then fluid from the groove reservoir is fed from underneath into the boundary layer using the downstream side 9*b* having just a small slope angle w2. Therefore, the velocity profile of the boundary layer 8 is changed reducing drag.

The projectile 1 according to the invention may be configured both as a solid bullet but also as a jacketed bullet or as a projectile with a more complex internal design, as is possible in the case of artillery ammunition, for example. Accordingly, the method according to the invention and the projectiles according to the invention are not limited to special projectile types or calibers either. In particular, small or medium calibers, e.g. conventional sports or hunting ammunition or also antiaircraft gun ammunition with 35 mm or 40 mm calibers, but also artillery shells with 155 mm, 175 mm or 203 mm calibers may be configured according to the invention. Depending on the intended use, the useful or explosive charges can then be arranged in the front part of the bullet or also in the inner jacket region, as is already similarly known from state-of-the-art submunitions. In particular, a projectile 1 according to the state of the art may have a sabot or a discarding sabot for firing or also be configured as a flanged bullet.

Figure 4A:
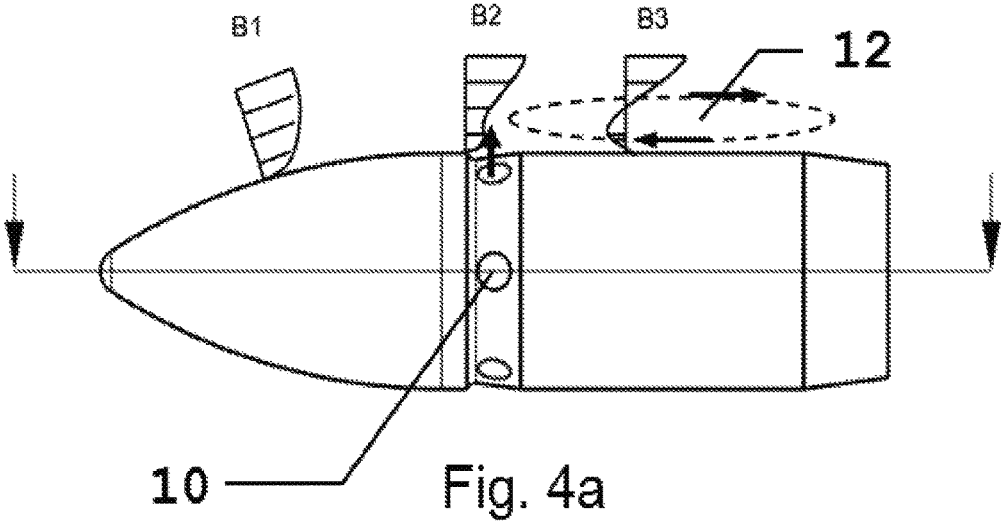
FIGS. 4*a-b* show the schematic representation of the method according to the invention with influencing of the boundary layer profile by a circulation flow with the help of the first exemplary embodiment of the projectile according to the invention.
Figure 4B:
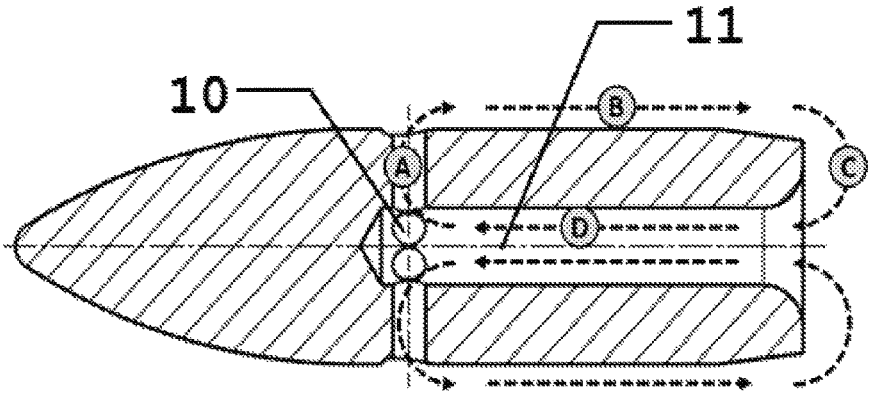

The influencing of the boundary layer profile by a circulation flow with the help of the first exemplary embodiment of the projectile according to the invention is explained in greater detail in FIGS. 4*a-b* as a schematic representation.

Through the measures mentioned according to the invention, the boundary layer flowing in over the nose of the projectile 1 has fluid flowing under it in the region of the groove 9, said fluid originating in the stagnation area and having the same speed as the projectile 1. This means that the flow around the projectile 1, as shown in FIGS. 4*a-b*, is altered. The boundary layer profiles B1, B2 and B3 in this case are represented in fixed-body coordinates.

- A boundary layer with a non-linear speed profile and a high gradient proximate to the wall B2 is formed over the nose of the projectile.
- At the groove, the inflowing boundary layer separates from the wall and is flowed under by the fluid conveyed from the inside into the groove. In this way, the boundary layer proximate to the wall is filled with fluid which substantially possesses the speed of the projectile B2.
- The boundary layer gradient is forced outwards, a separation bubble 12, B3 forms above the projectile, as a result of which the wall shear stress and the drag are correspondingly reduced.
- Part of the fluid from the stagnation area circulates in four stages A to D around the projectile. For clarification, the physical mechanisms and forces are explained in detail for each of the four steps (FIG. 4*b*):
- A. Pumping of fluid by centrifugal forces from the front end of the longitudinal channel 11 inside the projectile 1 through radial channels 10 into the encircling groove reservoir 9 in order to spread this fluid around the circumference of the projectile, and then feeding it along the slope of 9*b* into the boundary layer 8 from underneath. The energy for pumping originates from the rotational energy of the spin-stabilized projectile 1.

B. Transportation of fluid towards the tail 1*c* of the projectile 1 and the stagnation area 5 by shear forces within the boundary layer 8.

C. Collection of fluid in the stagnation area 5 by base drag pressure gradient behind the tail 1*c* of the projectile 1.

D Longitudinal transport of fluid from the stagnation area 5 through the longitudinal channel 11 towards the front of the channel 11 by longitudinal pressure gradient caused by the pumping mechanism of step A.

This circulation means that less kinetic energy flows off into the turbulent wake, which reduces the overall energy loss rate.

The base pressure of the projectile is increased by centrifugal forces in the intake which reduces the proportion of drag from the reduction in the base pressure without additional propellant gases. The pressure increase at the base originates from the circulation flow in this case.

Figure 5:
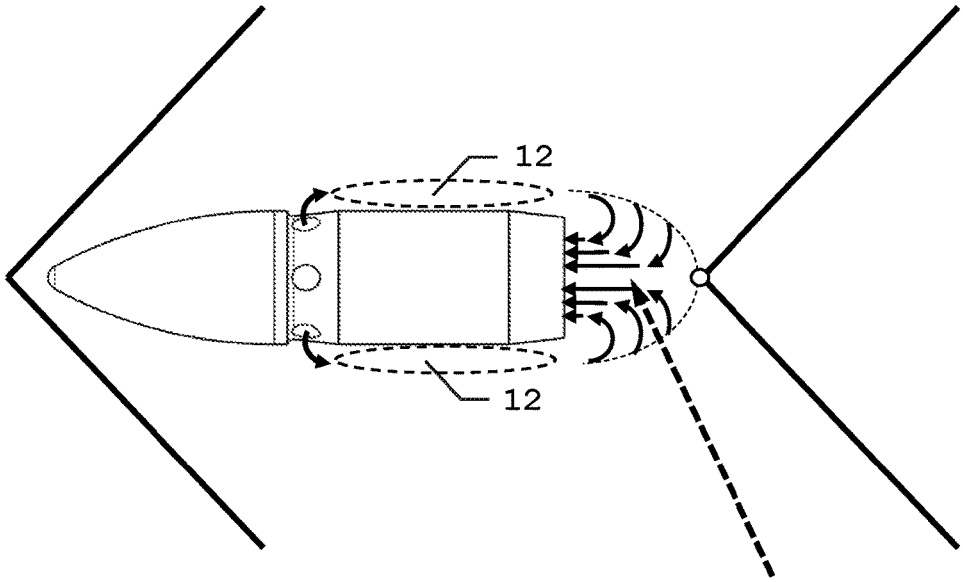
FIG. 5 shows the schematic representation of the flow at supersonic speed for the first exemplary embodiment of the projectile according to the invention and FIGS. 6*a-e* show the representation of a second exemplary embodiment of the projectile according to the invention, where the projectile is comprised of two parts.
Figure 6A:
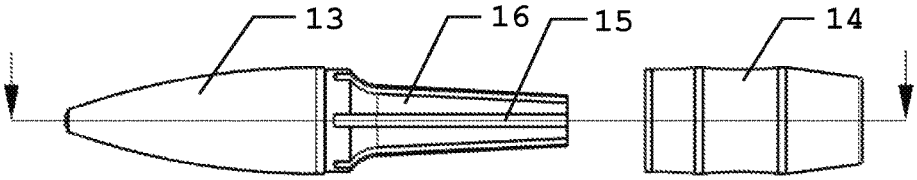
Figure 6B:
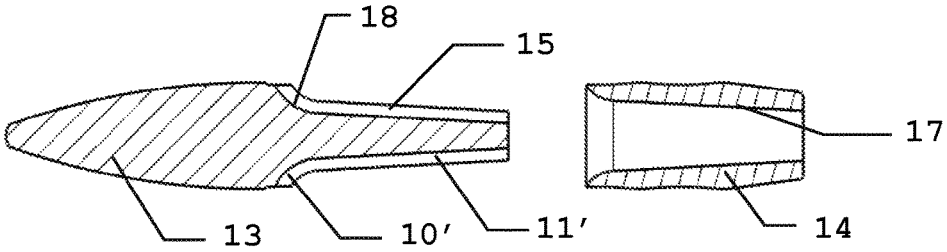
Figure 6C:
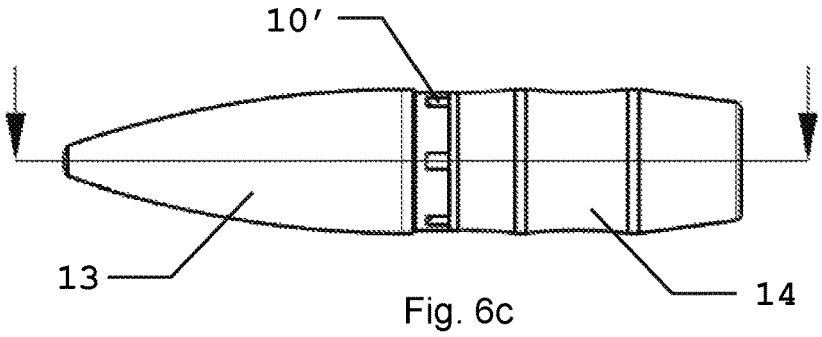
Figure 6D:
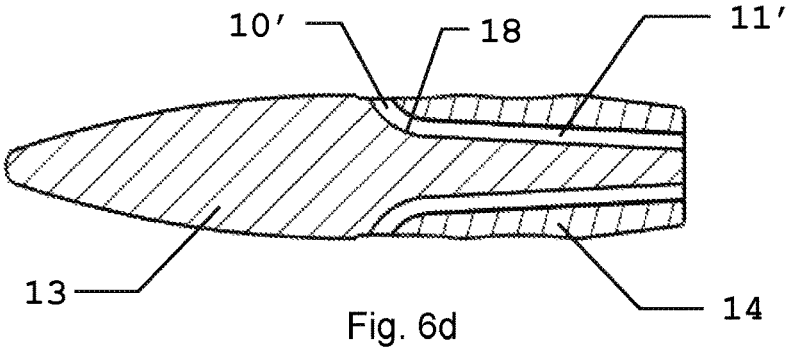
Figure 6E:
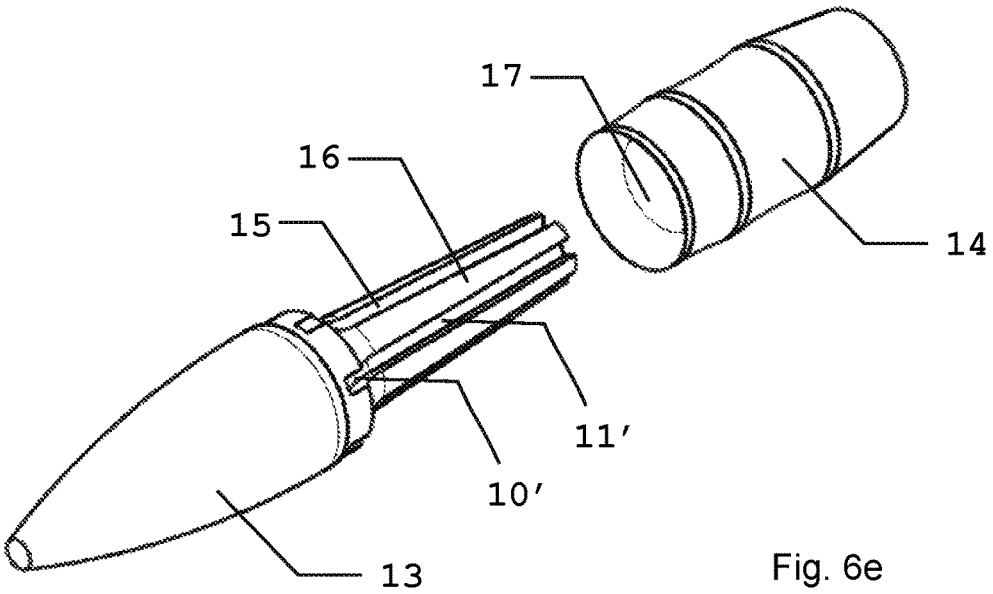
Figure 7A:
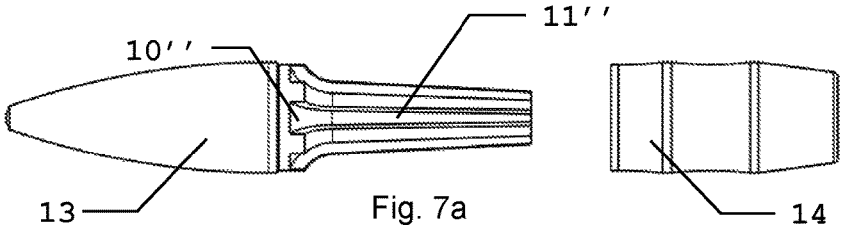
FIG. 7*a-e* show the representation of a third exemplary embodiment of the projectile according to the invention, where the channels are tapered in longitudinal and radial direction.
Figure 7B:
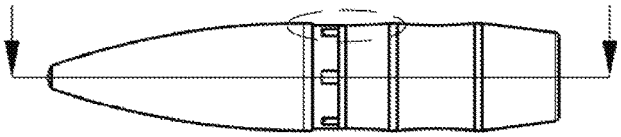
Figure 7E:
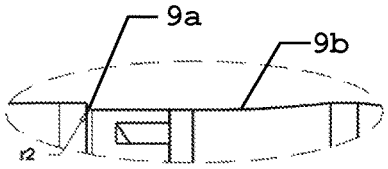
Figure 7C:
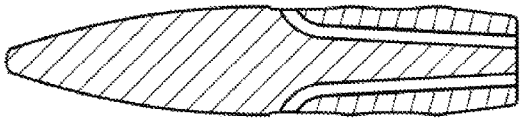
Figure 7D:
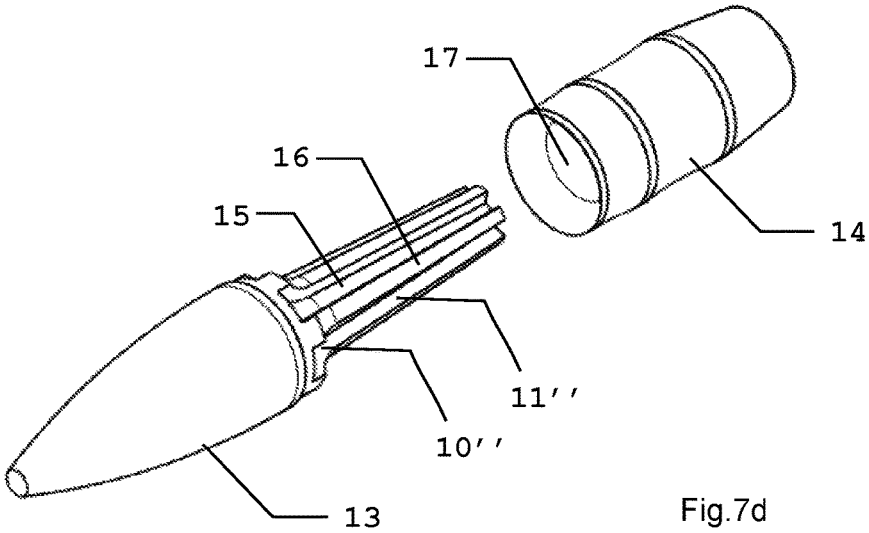
Figure 8A:
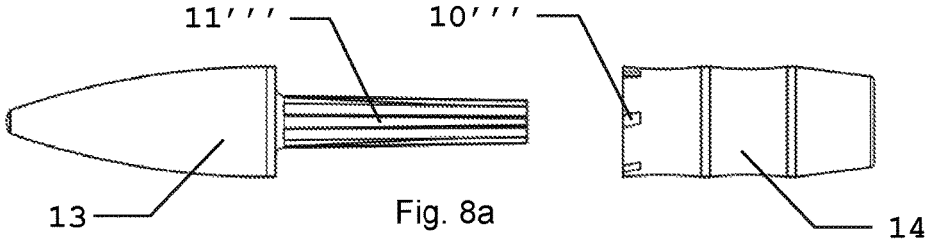
FIG. 8*a-e* show the representation of a fourth exemplary embodiment of the projectile according to the invention, where the radial channels are curved.
Figure 8B:
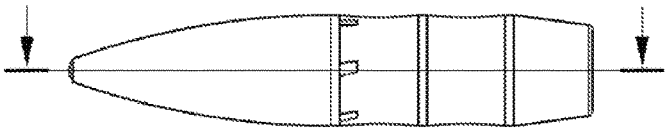
Figure 8E:
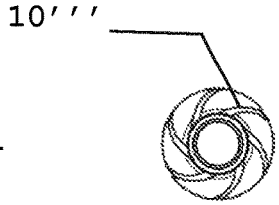
Figure 8C:
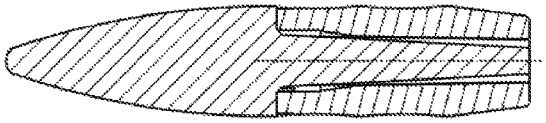
Figure 8D:
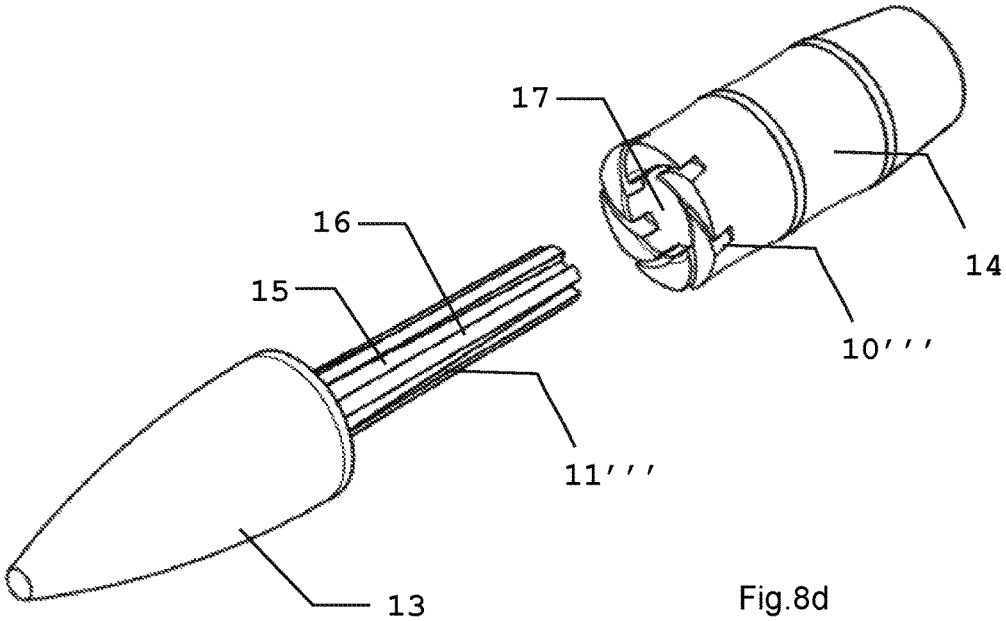

FIG. 5 shows the schematic representation of the flow at supersonic speed for the first exemplary embodiment of the projectile according to the invention. It can be seen from the flow field around the projectile which has changed compared with FIG. 2 that part of the fluid circulates from the stagnation area around the rear part of the bullet and does not reach the turbulent slipstream. This means that the energy loss of the projectile along the trajectory drops. The circulation produces a separation bubble 12 in the central region, which reduces the wall shear tension there and leads to a pressure increase in the incoming flow to the base or else the projectile tail, which reduces the proportion of drag from the flow surrounding the blunt tail. The reduction in drag forces corresponds to the reduction in energy loss. In this way, the range and target energy or target effect of the projectile are increased.

A second exemplary embodiment of the projectile according to the invention which particularly exhibits production advantages is depicted in FIGS. 6*a-e*.

Bores are disadvantageous for mass-production on cost grounds, which means that it is appropriate for projectiles to be produced from at least two parts 13 and 14, in which the required channels are configured as initially open grooves or hollow tracks 15, comprising both radial 10' and longitudinal 11' channels, being connected by a joint curved profile 18. A projectile according to the invention in this case is therefore composed of at least two parts 13 and 14, wherein at least one of the two parts 13 and 14 exhibits a plurality of hollow tracks 15 distributed uniformly over the periphery, preferably two to eight, wherein these form the radial transverse channels 10' and/or the at least one longitudinal channel 11' after joining together through the interaction of the two parts 13 and 14. In the front part, the plurality of recesses can be distributed uniformly over the periphery for this purpose. They connect the base of the projectile through an opening to the side wall or outer surface thereof and the rear opening and along with the inner cone they jointly form a system of channel-like tubes which allow fluid to be transported from the stagnation area into the wall boundary layer. In order to allow precise centering, it is advantageous for the part 13 forming the projectile tip to project in a pin-like fashion into the part 14 forming the projectile tail. In this way, the at least two parts 13 and 14 can be centered by the cone seat and joined by friction fit, form fit, adhesion, soldering or welding and connected to one another, wherein the parts 13 and 14 may also be made of different materials.

So that the channels are formed as a recess in one of the first of the two parts 13 and 14, wherein the second part covers the open channel side during joining, so that overall once again tubes that can be flowed through longitudinally and therefore the channels 10' and 11' according to the invention are formed.

The second exemplary embodiment of the projectile according to the invention therefore comprises two parts 13 and 14 which are centered via a cone seat 16 and 17 and can be joined in the press fit by friction. Alternatively, the parts can be connected to one another by form fitting, adhesion, welding, soldering or another joining method. The streamlined rounding of the channels, i.e. the transition from the longitudinal channel 11' to the transverse channels 10' and the transition to the lateral wall opening can be particularly advantageously configured in this case, as a result of which the radial transverse channels 10' and the at least one longitudinal channel 11' have a joint curved profile 18. This means that a continuous, streamlined profile of the channel as a whole can be realized.

In principle, however, the hollow tracks required in front of the channels can be introduced both solely in the first part 13 and also solely in the second part 14 or else in both parts 13 and 14. They may be configured parallel to the longitudinal axis or also in spiral form, wherein at least two channels are required in order to avoid an imbalance, preferably, however, two to eight channels are distributed evenly about the periphery, depending on the caliber. From a production point of view, the advantage is that both parts 13 and 14 can be made from solid cylindrical material and from tubes by cold forming, which facilitates simple and also cost-effective production. It is likewise advantageous in this case for the two parts to be capable of being made of different materials.

FIG. 7*a-d* show a third exemplary embodiment of the projectile according to the invention, where the longitudinal and radial channels are tapered to achieve an increasing cross section of the channels back to front. This helps to increase the mass flow of the secondary flow and reduced energy losses. The longitudinal channel 11" and the radial channel 10" both are designed as diffuser channels with increasing cross section and flow area by tapering the channel walls. Both parts 13 and 14 then are joined by cone seat 16 and 17.

FIG. 8*a-d* show a fourth exemplary embodiment of the projectile according to the invention, where the longitudinal and radial channels 11'" are tapered and the radial channels 10'" are curved. Here the channels are built into both parts 13 and 14 being joined by cone seat 16 and 17. Curved radial channels can be build pointing into or against the spinning direction of the projectile.

Figure 9A:
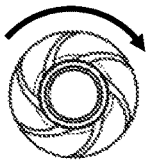
FIG. 9*a-b* show the representations of exemplary embodiments of radial curved channels for clockwise rotation of the projectile, with channels pointing in or against the direction of the rotation.
Figure 9B:
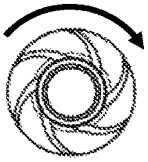

FIG. 9*a-b* show curved radial channels 10'" pointing in and against spin direction for clockwise rotation.

Figure 10A:
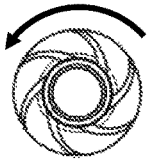
FIG. 10*a-b* show the representations of exemplary embodiments of radial curved channels for counter clockwise rotation of the projectile, with channels pointing in or against the direction of the rotation.
Figure 10B:
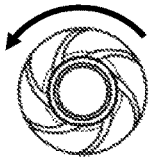

FIG. 10*a-b* show curved channels pointing in and against spin direction for counter-clockwise rotation.

Figure 11A:
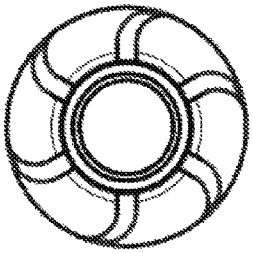
FIG. 11*a-c* show the representations of exemplary embodiments of radial curved channels being sickle-shaped, curved radially converging, or curved radially diverging.
Figure 11B:
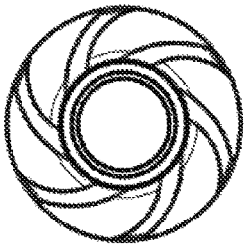
Figure 11C:
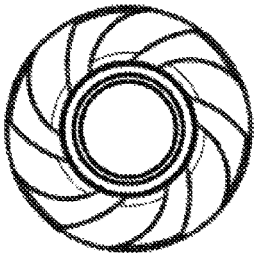

FIG. 11*a-c* show curved radial channels 10'" being sickle-shaped or curved with converging or diverging cross sections.

The invention claimed is:

1. A method for increasing a range of a spin-stabilized projectile moving in a surrounding medium, wherein the surrounding medium is conveyed from a stagnation area of the spin-stabilized projectile by a rotational energy of the spin-stabilized projectile under an inflowing boundary layer at an outer surface of the spin-stabilized projectile and a speed gradient of the inflowing boundary layer proximate to the outer surface of the spin-stabilized projectile is therefore lowered, the method comprising:

(A) pumping of a fluid by centrifugal forces from a front end of at least one longitudinal channel inside the spin-stabilized projectile through radial channels into at least one encircling groove reservoir to spread the fluid around a circumference of the spin-stabilized projectile, and then feeding the fluid along a sloped back face of the encircling groove reservoir into the inflowing boundary layer while pumping energy originates from the rotational energy of the spin-stabilized projectile; followed by (B) transportating the fluid towards a tail of the spin-stabilized projectile and the stagnation area by shear forces within the inflowing boundary layer; followed by (C) collecting the fluid in the stagnation area by a base drag pressure gradient behind the tail of the spin-stabilized projectile; and followed by (D) longitudinally transporting the fluid from the stagnation area through the at least one longitudinal channel towards the front end of the at least one longitudinal channel by a longitudinal pressure gradient caused by the pumping of step A.

2. A spin-stabilized projectile comprising:

an outer surface;

a projectile tip; and a projectile tail, wherein the outer surface has at least one encircling groove that permanently opens to the a surrounding medium and is connected by radial transverse channels to at least one longitudinal channel inside the spin-stabilized projectile, the at least one longitudinal channel is connected to an opening in the projectile tail during a complete flight.

3. The spin-stabilized projectile as claimed in claim 2, wherein the at least one encircling groove has an upstream side of the at least one encircling groove with a forward slope in a flight direction and is steeper than a downstream side of the at least one encircling groove, and the downstream side has a slope angle with a backward slope against the flight direction.

4. The spin-stabilized projectile as claimed in claim 2, wherein the radially transverse channels are uniformly distributed over a periphery of the spin-stabilized projectile and are connected to the at least one encircling groove.

5. The spin-stabilized projectile as claimed in claim 2, wherein a transition between the projectile tail and the at least one longitudinal channel is formed in a streamlined manner that is rounded.

6. The spin-stabilized projectile as claimed in claim 2, wherein the spin-stabilized projectile has a same diameter near the upstream side and the downstream side.

7. The spin-stabilized projectile as claimed in claim 2, wherein the spin-stabilized projectile is composed of two parts, wherein an upstream part has a cone shaped pin pointing downstream and a downstream part has an axial through-hole, and wherein at least one of the upstream part or the downstream part has a plurality of hollow tracks distributed uniformly over a periphery of the spin-stabilized projectile that forms the radial transverse channels or the at least one longitudinal channel after joining the upstream part and the downstream part together.

8. The spin-stabilized projectile as claimed in claim 7, wherein the upstream part has a cone shaped pin that is inserted into the axial through-hole of the downstream part.

9. The spin-stabilized projectile as claimed in claim 7, wherein the upstream part and the downstream part are centered by a cone seat that connects the upstream part to the downstream part by one of a friction fit, a form fit, an adhesion, a soldering or a welding.

10. The spin-stabilized projectile as claimed in claim 7, wherein the upstream part and the downstream part are made of different materials.

11. The spin-stabilized projectile as claimed in claim 2, wherein the radial transverse channels and the at least one longitudinal channel form a continuous, curved profile.

12. The spin-stabilized projectile as claimed in claim 2, wherein the radial transverse channels have a curved profile running in or against a spinning direction.

13. The spin-stabilized projectile as claimed in claim 2, wherein the radial transverse channels exhibit have a profile tapering in or against a radial direction.

14. The spin-stabilized projectile as claimed in claim 2, wherein the longitudinal channel has a cross section that changes in an axial direction.

15. A spin-stabilized projectile, comprising:

an outer surface;

a projectile tip; and a projectile tail, wherein the outer surface has at least one encircling groove permanently open to a surrounding medium that is connected by radial transverse channels to at least one longitudinal channel inside the spin-stabilized projectile, the at least one longitudinal channel is connected to an opening in the projectile tail during a complete flight, and a radial distance between an entry and an exit of each of the radial transverse channels is at least one-third of a diameter of the spin-stabilized projectile.

* * * * *